US006070282A

United States Patent [19]

Underly et al.

[11] Patent Number: 6,070,282

[45] Date of Patent: Jun. 6, 2000

[54] FABRIC SUPPORT DEVICE FOR AN AUTOMATIC WASHER

[75] Inventors: Kristina K. Underly; Joan Diane Banks, both of Berrien Springs, Mich.

[73] Assignee: Whirlpool Corporation, Benton Harbor, Mich.

[21] Appl. No.: 09/382,015

[22] Filed: Aug. 24, 1999

Related U.S. Application Data

[63] Continuation-in-part of application No. 09/158,242, Sep. 22, 1998, abandoned.

[51] Int. Cl.[7] ..... D06F 7/00; D06F 35/00

[52] U.S. Cl. ..... 8/159; 68/235 R; 383/117

[58] Field of Search ..... 68/235 R; 383/43, 383/117; 8/159

[56] References Cited

U.S. PATENT DOCUMENTS

| | | | |
|---|---|---|---|
| 850,697 | 4/1907 | Voss | 68/235 R X |
| 1,897,018 | 3/1933 | Draheim | 383/117 X |
| 2,241,309 | 5/1941 | Kovalik | 383/43 X |
| 3,769,819 | 11/1973 | Contreras | 68/235 R X |
| 4,174,585 | 11/1979 | Beesley | 383/117 X |

FOREIGN PATENT DOCUMENTS

| | | | |
|---|---|---|---|
| 513021 | 11/1930 | Germany | 68/235 R |

OTHER PUBLICATIONS

Japanese Product Literature Pertaining to Lingerie Bags.
Korean Product Literature Pertaining to Lingerie Bags.

*Primary Examiner*—Philip R. Coe
*Attorney, Agent, or Firm*—Thomas J. Roth; Joel M. Van Winkle; Robert O. Rice

[57] ABSTRACT

A fabric support device is provided for use in a wash basket of an automatic washer. The fabric support device includes an elongated bag having a generally rectangular shape, the bag being formed from a mesh material which allows fluid to pass therethrough. The bag has an open side edge such that clothes can be inserted into the bag. At least one spring member may extend longitudinally along the bag wherein the bag may be rolled into a generally cylindrical shape against the bias of the spring and inserted into the wash basket. Upon release, the bag is biased outwardly against the inner wall of the wash basket such that clothes are supported within the wash basket for washing but are not subject to stretching, twisting and excessive movement.

20 Claims, 5 Drawing Sheets

FABRIC SUPPORT DEVICE FOR AN AUTOMATIC WASHER

This is a continuation-in-part of application Ser. No. 09/158,242, entitled "FABRIC SUPPORT DEVICE FOR AN AUTOMATIC WASHER", filed on Sep. 22, 1998, and now abandoned.

BACKGROUND OF THE INVENTION

1. Field of the Invention

This invention relates generally to the field of washing machine accessories and more particularly to a fabric support device for use in a wash basket of an automatic washer.

2. Description of the Related Art

Automatic washers are widely used to clean clothes and laundry items Washers are typically designed to flex and move cloth items such that mechanical energy is applied to the cloth items which are to be cleaned. The way in which mechanical energy is applied to cloth items varies according to the type of automatic washer. One type of conventional vertical axis automatic washer employs an agitator which rotates back and forth within a wash basket to apply mechanical energy to the clothes items loaded therein. Another type of vertical axis automatic washer includes a vertical axis wash basket having a bottom impeller or pulsator, provided along the bottom of the wash basket, for moving cloth items and fluid within the wash basket. In horizontal axis automatic washers, cloth items are tumbled within a horizontally aligned wash basket and thereby undergo mechanical action.

For most fabric items, the mechanical action or force applied during a wash cycle is not detrimental or unduly damaging. However, for a small portion of laundry items which are particularly delicate, the application of the mechanical energy by either an agitator, bottom impeller or through tumbling can be damaging. As a result, delicate cloth items are frequently dry cleaned or hand washed rather than being washed in an automatic washer. Unfortunately, dry cleaning is relatively expensive and does not always provide a desirable fabric care result. Moreover, hand washing is time consuming and likewise does not always provide a desirable fabric care result.

There have been some efforts in the past to provide an accessory for an automatic washer which would allow the automatic washer to wash delicate fabric items. For example, it is known to provide a small, inner basket which may be mounted onto an agitator within a large wash basket. Delicate fabric items may be placed into the inner basket and are subject to a relatively gentle wash action during the operation of the washer.

It is also known to place delicate clothes within a mesh container which can then be rolled up or folded and placed within a conventional washer. The mesh container has sufficient rigidity to support the clothes and prevent twisting and excessive motion. In this manner, delicate clothes items are constrained and protected from the strong currents and movement of wash liquid within the washer. However, delicate clothes item mesh containers which have been used in the past tend to move around within the wash basket of the automatic washer in which they are used such that cloth items within these mesh containers are exposed to mechanical forces. Moreover, past delicate cloth item mesh containers are relatively unsuited for use in automatic washers employing center agitators.

SUMMARY OF THE INVENTION

It is an object of the present invention to provide a fabric support device for supporting delicate fabric or clothes items within an automatic washer in a manner which allow the fabric items to be washed but minimizes wear and shrinkage of the delicate fabric items.

It is further an object of the present invention to provide a fabric support device which is compatible with any type of automatic washer having a wash basket. More particularly, it is an object of the present invention to provide a fabric support device which may be used in a vertical axis automatic washer having either a center agitator or a bottom impeller or in a horizontal axis or tilt axis washer.

It is still further an object of the present invention to provide a fabric support device which may be easily inserted and removed from within the wash basket of an automatic washer.

It is also an object of the present invention to provides a fabric support device which supports clothes items within a wash basket such that wash liquid currents may readily pass through and around the clothes items while minimizing the twisting, flexing and excessive motion of the clothes items.

These and other objects are achieved by the present invention where a fabric support device is provided for use in a wash basket of an automatic washer. In a first embodiment, the fabric support device includes an elongated bag having a generally rectangular shape, the bag is formed from a mesh material which allows fluid to pass therethrough. The bag has an opening such that delicate fabric items can be inserted into the bag. At least one spring member extends longitudinally along the bag wherein the bag may be rolled into a generally cylindrical shape against the bias of the spring and inserted into the wash basket. Alternatively, the bag may include a wall having sufficient rigidity and flexibility that the wall provides the necessary spring resiliency. Upon release of the fabric support device within a wash basket, the bag is biased radially outwardly against the inner wall or surface of the wash basket such that delicate fabric items are supported within the wash basket for washing but are not subject to the twisting, flexing and excessive motion caused by the action of the agitator, the bottom impeller or from the action of tumbling—depending on the type of automatic washer in which the fabric support device is used.

In a second embodiment, the fabric support device includes an elongated bag having a generally rectangular shape. The bag has an open side edge such that delicate fabric items can be inserted into the bag. A plurality of rods are attached to the bag and extend transversely across the bag for preventing collapse of the bag. A pair of spring members extend along the longitudinal edges of the bag. The spring members are generally formed in a C-shape such that the bag is arranged in a generally cylindrical shape having a longitudinal slit or gap. The fabric support device is inserted into the wash basket by compressing the springs to reduce the diameter of bag such that the fabric support device fits through a top opening into the wash basket. Upon release of the springs, the fabric support device is outwardly biased such that the bag is positioned adjacent the inside surface of the wash basket.

DESCRIPTION OF THE PREFERRED EMBODIMENTS

The description of the preferred embodiments of the present invention will be made in conjunction with various different automatic washer configurations and in particular, the present invention is shown as used in a vertical axis automatic washer having a center agitator, a vertical axis automatic washer having a bottom impeller and a horizontal axis automatic washer. However, it should be understood that the fabric support device of the present invention may be used in any type of automatic washer having a generally cylindrical wash basket. Moreover, the fabric support device may be used in clothes dryers which have a generally cylindrical drum.

Figure 1:
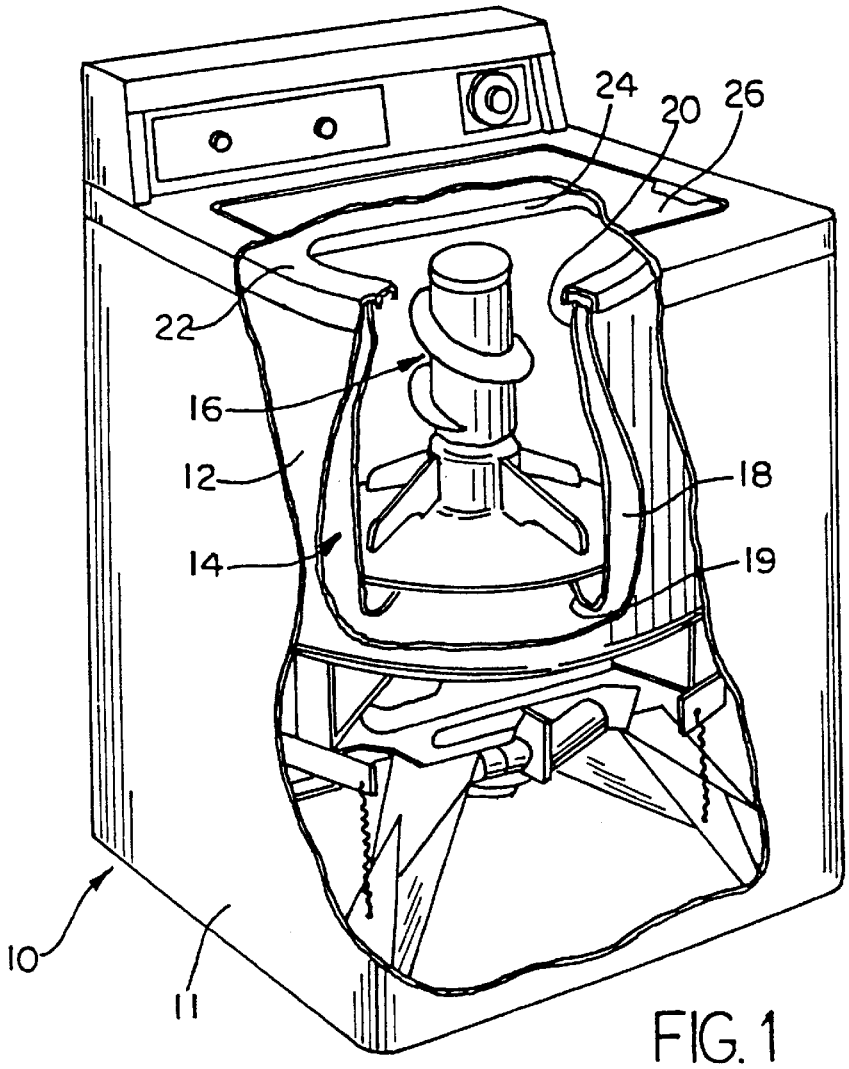
FIG. 1 is a perspective view of a washing machine, partially cut away.

Referring now to the drawings, and in particular FIG. 1, there is shown a washer 10, illustrative of a type of washer in which the invention may be used, having an outer cabinet 11 and an inner wash tub 12. A wash basket 14 is located within the wash tub 12. A center agitator 16 is disposed within the wash basket for oscillation therein. The wash basket 14 includes a cylindrical side wall 18, a bottom wall 19 and an open upper end 20. A top member 2 having a center opening 24 is connected to the upper end of the wash tub 12 and is disposed above the open upper end 20 of the wash basket 14. In this manner, clothes are placed into the wash basket by passing them through the opening 24. A lid 26 is hingedly supported by the cabinet above the wash basket open end 20. A console is provide having controls for initiating a plurality of wash cycles.

Figure 2:
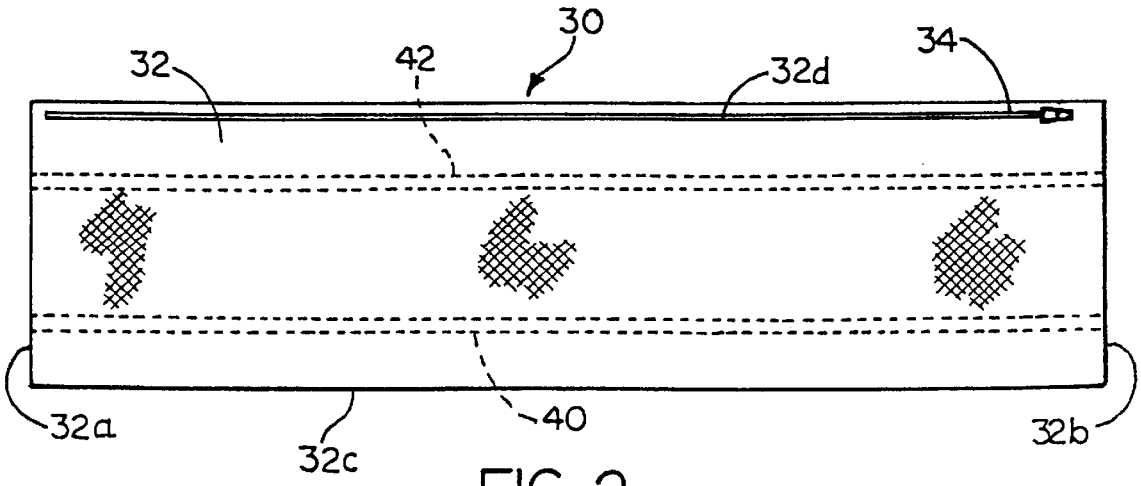
FIG. 2 is an elevational view of a first embodiment of a fabric support device of the present invention.
Figure 3:
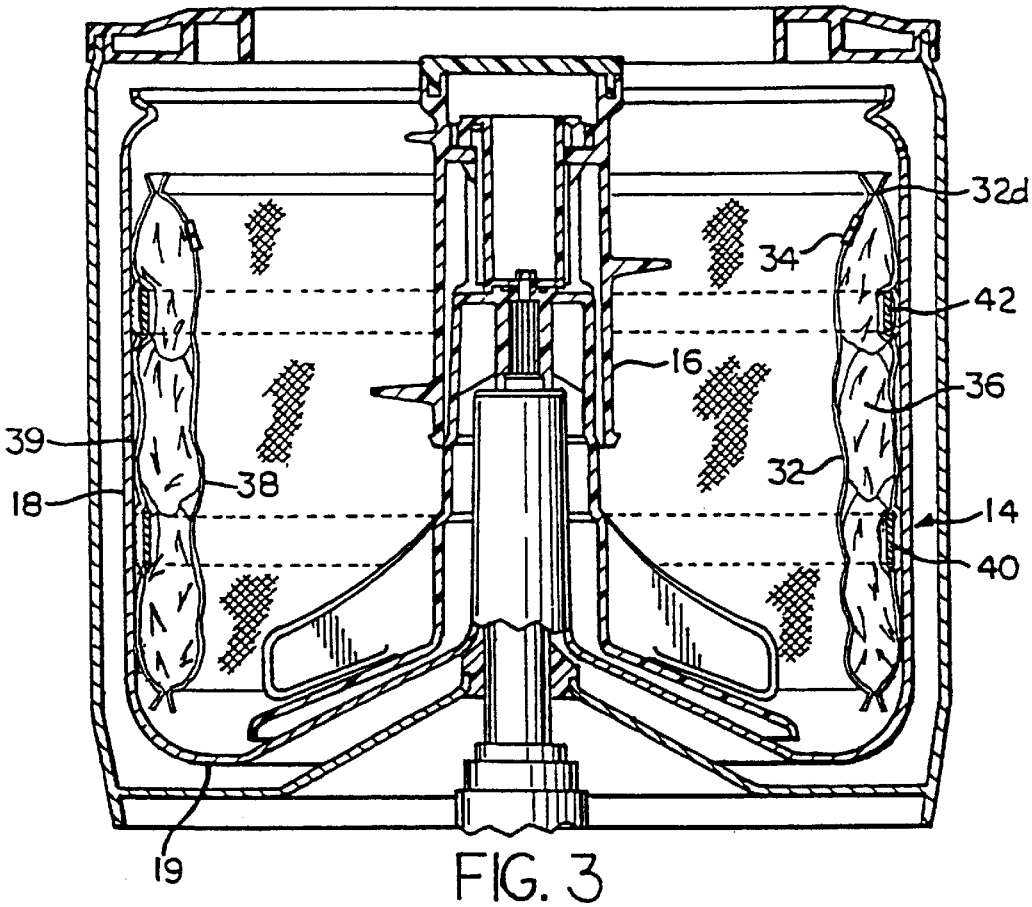
FIG. 3 is a cross section through the tub, basket and agitator of the washing machine shown in FIG. 1 and illustrates the placement of the fabric support device into the wash basket of a vertical axis washing machine having a center agitator.

FIGS. 2 and 3 illustrate a first embodiment of the fabric support device of the present invention. The fabric support device 30 comprises a container having perforate walls for supporting delicate clothes items annularly within a wash basket or drum. Specifically, the fabric support device comprises a mesh bag 32 having a generally elongated, rectangular shape. The bag has closed transverse edges 32*a*, 32*b* and a closed longitudinal edge 32*c*. An opening is provided along the longitudinal edge 32*d* and is provided with a closure device 34 such as a zipper or a zip-lock® type device. Alternatively, the longitudinal edge 32*d* may be open and may be provided with a closure device. In this manner, delicate clothes items 36 may be inserted into the bag and retained therein.

The mesh bag 32 has a front wall 38 and a back wall 39. The front wall 38 is preferably a relatively light netting material. The back wall 39 is a more rigid plastic mesh. The back wall 39 is still flexible but has enough rigidity to support the fabric support device 30 in an upright orientation when the device 30 is rolled into a cylindrical shape. As seen in FIG. 3, the front and back walls 38 and 39 are joined along their side edges while the closure device 34 is provided in the front wall 38 along the top longitudinal edge 32*d*. The size of the mesh openings in the front and back walls 38, 39 are sized to allow as much water as possible through the mesh material for the purposes of cleaning the clothes items placed within the mesh bag 32 but yet small enough to avoid catching clothing trim such as buttons. The mesh openings may preferably be 0.25 in. diameter openings.

The fabric support device 30 includes a plurality of springs 40, 42 extending longitudinally along the length of the bag. The springs 40, 42 may be elongated, resilient plastic members formed from a suitable material such as Celcon. These springs are preferably attached to the bag 32 by, for example, insertion into corresponding, elongated pockets formed into the bag 32. Alternatively, the springs 40, 42 may be adhered to the bag 32 or connected in any other known method. The springs may be attached to the back wall 39 or alternatively, the springs may be attach to the front wall 38.

As best shown in FIG. 3, after delicate fabric or cloth items 36 are placed into the fabric support device 30, the fabric support device 30 may be rolled into a generally cylindrical shape and inserted into the wash basket 14. Upon release of the fabric support device 30, the springs bias the mesh bag 32 against the inner cylindrical wall 18 of the wash basket 14. In this manner, delicate fabric or cloth items 46 may be supported within the wash basket 14 and washed without having the fabric items undergoing substantial stretching, twisting, flexing and other movement or agitation.

The size of the mesh bag 32 can vary but is dictated, to a degree, by the size of the wash tub. The length of the mesh bag 32 preferably is such that when the device 30 is rolled into cylindrical shape, the shape of the device is capable of fitting within the open upper end 20. Moreover, the height of device 30 is limited by the height of the wash basket into which the device 30 is to be inserted. Preferably, the fabric support device 30 is sized to have a volume capable of receiving several delicate clothes items. For best wash performance, the clothes items placed in the device 30 should be evenly distributed within the device and spread out as much as possible.

Figure 4:
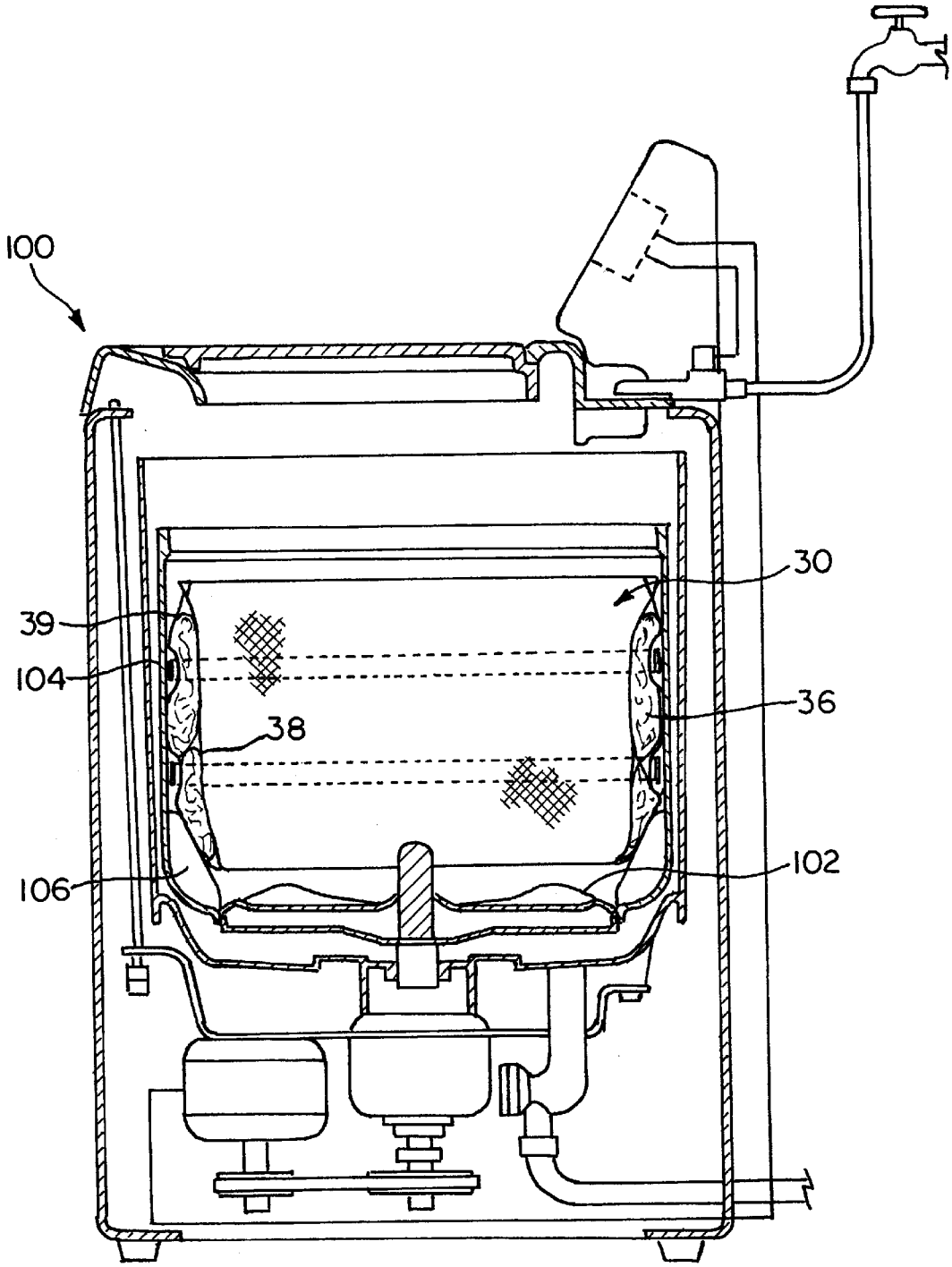
FIG. 4 is a cross section through an automatic washer having a tub, basket and bottom impeller which illustrates the placement of the fabric support device into the wash basket of a vertical axis washing machine having a bottom impeller.
Figure 5:
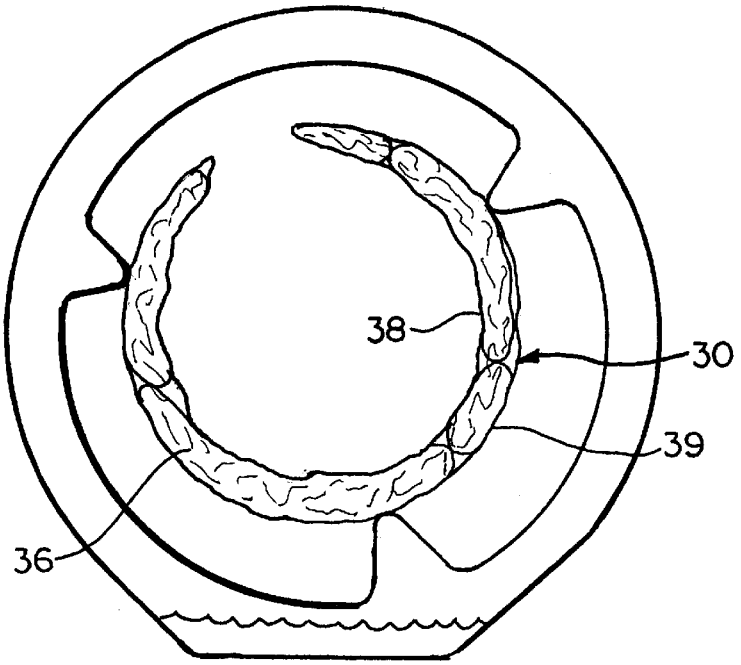
FIG. 5 is a cross section through a horizontal axis automatic washer having a tub and wash basket which illustrates the placement of the fabric support device into the wash basket of a horizontal axis washing machine.

FIG. 4 illustrates the use of the fabric support device of the present invention in a vertical axis washer 100 having a bottom impeller 102 located at the bottom of a wash basket 104. The device 30 is designed to fit within the wash basket 104 in a similar manner as described above with regard to FIG. 3. As can be seen, the fabric support device 30 can readily conform around corner gussets 106 in the wash basket 104. In a like manner, the fabric support device 30 may fit within wash baskets provided with different side ribs or baffles. The fabric support device 30 may also be used in horizontal axis washers as shown in FIG. 5.

Figure 6:
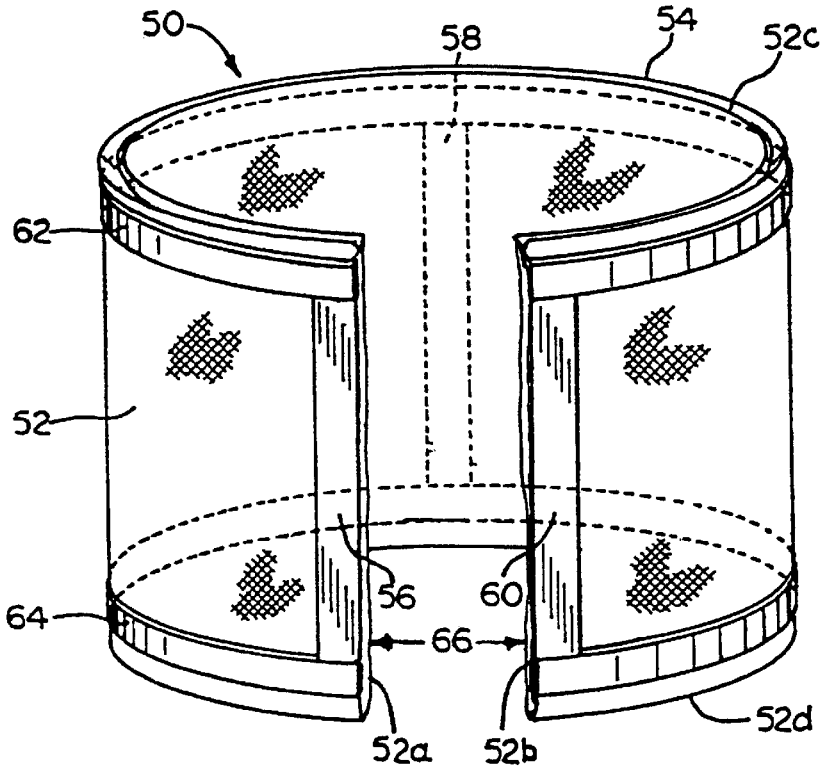
FIG. 6 is a perspective view of a second embodiment of the fabric support device of the present invention.

FIG. 6 illustrates an alternative embodiment of the fabric support device of the present invention. In this embodiment, the fabric support device 50 includes a mesh bag 52 having a generally elongated, rectangular shape. The bag has opposed transverse edges 52*a*, 52*b* and opposed longitudinal edges 52*c*, 52*d*. Edges 52*a*, 52*b* and 52*d* are closed or sealed edges while edge 52*c* is open. A closure device 54, such as a zipper or zip-lock® type device, is located along the longitudinal edge 52*c* such that fabric items may be placed within the mesh bag 52 and maintained therein.

Alternatively, the longitudinal edge 52*c* may be open with no closure device provided. In such a configuration, the cloth items placed in the fabric support device 50 are secured within the mesh bag by the operation of gravity and friction and the natural resiliency of the mesh bag.

A plurality of support rods 56, 58 and 60 are attached to the mesh bag 52 and extend transversely across the bag 52. A pair of spring members 62 and 64 are located along the opposed longitudinal edges 52*c* and 52*d*. The spring members 62 and 64 are resilient and are generally formed into a C shape. The rods and spring members are preferably attached to the bag 52 by for example, insertion into corresponding pockets formed into the bag 52.

As can be readily understood, the rods 56, 58, 60 and the spring members 62, 64 form a frame work for giving structure to the mesh bag 52 and for conforming the bag 52 into a generally cylindrical shape having a longitudinal gap 66. Delicate items which need to be washed may be placed within the bag 52 through the open edge 52*c* and secured therein by closing the closure device 54.

Washing the delicate fabric items is accomplished by placing the fabric support device within the wash basket 14. The spring members 62, 64 are sized such that in a relaxed position they form a circular shape having a diameter which is slightly larger than the inner diameter of the wash basket 14. To place the fabric support device 50 within the basket 14, the springs 62, 64 are compressed such that the diameter of the support device 50 is reduced to less than the diameter of the opening 24. In this manner the support device 50 can pass through the opening 24 and upon release of the springs 62, 64 the support device is biased outwardly to press up against the inner surface of the wash basket 14.

In this manner, the bag 52 is supported adjacent the inner surface of the wash basket 14 and the delicate fabric items are secured within the bag 52. The delicate items are exposed to the water, detergent and wash currents within the wash basket but are not subject to excessive mechanical action in a manner that would cause the delicate fabric items undue wear.

Figure 7:
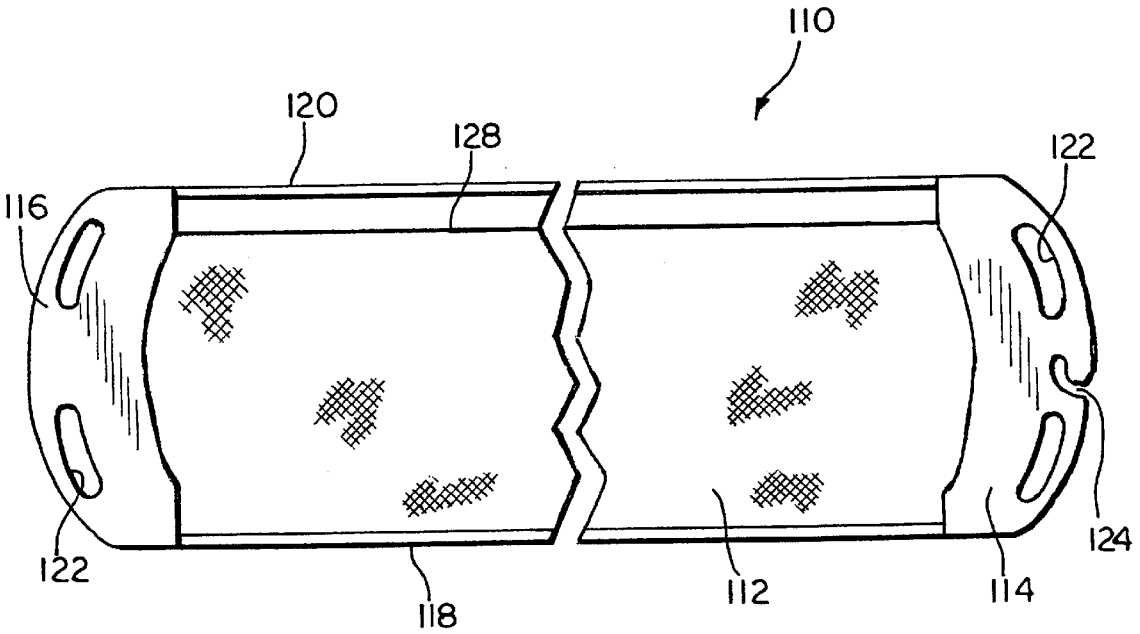
FIG. 7 is a perspective view of a third embodiment of the fabric support device of the present invention.

FIG. 7 illustrates a third embodiment of the present invention. A fabric support device 110 is shown which includes a central, mesh body 112 and a right end member 114 and a left end member 116. The mesh body 112 comprises two mesh walls or panels joined along their outer periphery for forming a generally rectangular bag having a bottom edge 118 and a top edge 120. The bottom and top edges may be sealed together, sewn together or joined in any known manner. Alternatively, the mesh body 112 may be formed as a tubular structure with ends joined to the right end member 114 and the left end member 116.

The end members 114, 116 are preferably formed from a plastic material and are attached to the mesh body 112 by any know method including welding, adhesives, insert molding or other methods. The end members 114, 116 may be provided with handle openings 122. Additionally, at least one end member may be provided with a curved slot 124 such that the fabric support device can be hung up on a hook.

The mesh body 112 is provided with an opening 128 for allowing cloth items to be placed within the fabric support device. The opening 128 is provided adjacent the top edge 120 and may be an elongated slit or may be a flap type opening with a portion of mesh material laying over the opening. Alternatively, the opening 128 may be provided with a closure device such as Velcro® material, a zipper or any other know closure system.

Figure 8:
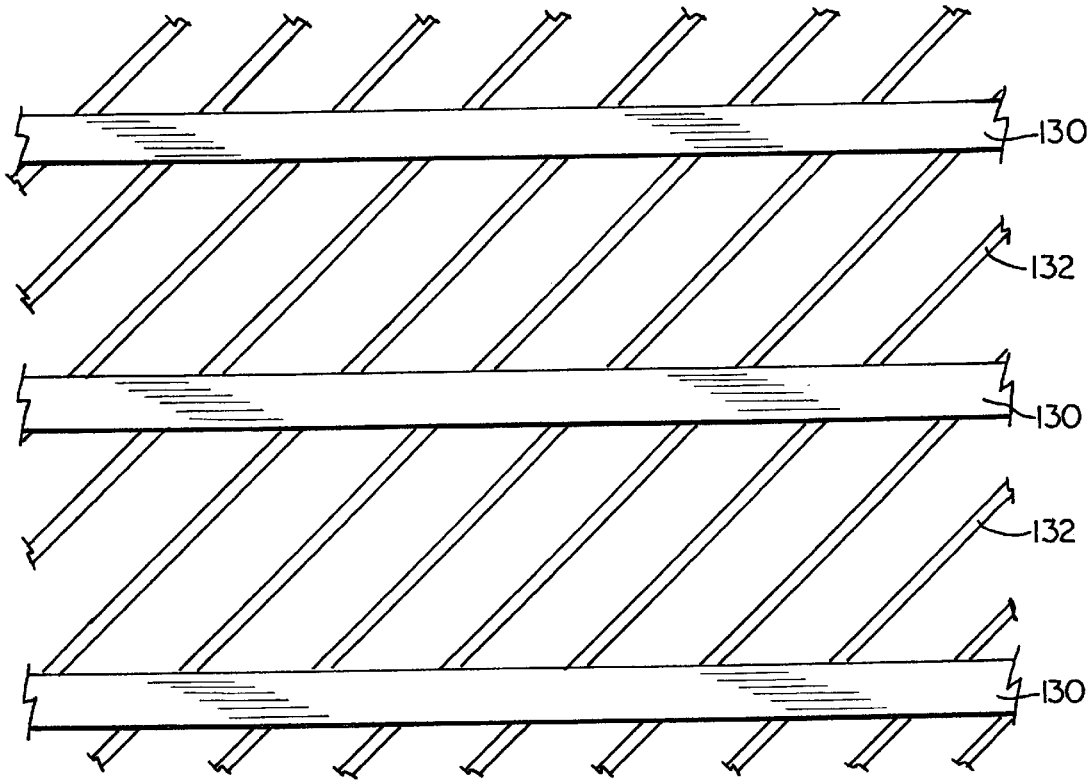
FIG. 8 is an enlarged view of a portion of the fabric mesh used in forming the fabric support device of FIG. 7.

As described above, the fabric support devices of the present invention are designed to be rolled into a cylindrical form and then inserted into a wash basket of an automatic washer. The first and second embodiments shown above each contained longitudinally extending spring members that provided the needed resiliency for the fabric support devices to radially expand after the device has been inserted into a wash basket. The third embodiment, shown in FIG. 7, illustrates a fabric support device wherein the mesh material which forms mesh body 112 has a structure which provides the needed resiliency without requiring additional spring elements. FIG. 8 illustrates an enlarged view of the mesh material which may be used to fabricate a fabric support device of the present invention. The mesh material comprises a plurality of relatively large strands 130 and a plurality of relatively thin strands 132. The large strands 130 in effect are spring elements and provide the mesh fabric with substantial strength and resiliency such that the mesh material has sufficient internal structure to be used to fabricate a fabric support device which does not require separate spring elements added to the fabric support device. To give the fabric support device 110 sufficient vertical and horizontal strength, one wall of the fabric support device may be formed with the large strands 130 oriented in a diagonal orientation with the large strands running upwardly while the other wall may be formed with the large strands 130 oriented in a diagonal orientation with the large strands running downwardly.

Table 1, shown below, illustrates the performance that can be achieved using the fabric support device of the present invention to wash delicate cloth items as compared to dry cleaning, handwashing, and a horizontal washer.

TABLE 1

| | Shrinkage Performance (%): Post wash size/original size | | | | | |
|---|---|---|---|---|---|---|
| Treatment | Wool Garment | Wool Swatch | Silk Garment | Silk Swatch | Rayon Garment | Rayon Swatch |
| Dryclean | 3.3% | 5.4% | 3.3% | 4.4% | 6.2% | 4.7% |
| Handwash | 2.0% | 4.9% | 7.6% | 10.9% | 13% | 17.9% |
| Horizontal Axis Washer (HAW) - special cycle (high end) | 3.0% | 5.6% | 5.0% | 11.6% | 18.0% | 19.1% |
| Present invention used in HAW (low end) | 0.3% | 4.8% | 8.3% | 11.7% | 9.6% | 17.5% |

It can be clearly seen that the fabric support device of the present invention allows delicate items, particularly woolen items, to be washed while minimizing shrinkage. In fact, as shown in FIG. 1, for wool garments, the present invention performs better, from a shrinkage standpoint, than dry cleaning.

The present invention, therefore, is directed to a novel fabric support device for delicate clothes items for use in a washing machine. The fabric support device supports the clothes within a wash basket in a manner which minimizes cloth stretching, twisting and excessive movement such that cloth item damage is prevented. The present invention may be used in a vertical axis or horizontal axis washer. Less delicate cloth items may be cleaned in the automatic washer, outside of the fabric support device, at the same time that the delicate items are being washing in the device of the present invention.

Although the present invention has been described with reference to specific embodiments, those of skill in the Art will recognize that changes may be made thereto without departing from the scope and spirit of the invention as set forth in the appended claims. For example, while the above described embodiments disclose a mesh bag construction, the fabric support device could also be a molded plastic member. In a molded plastic configuration, the fabric support device could be formed with natural resiliency such that spring elements would not be required.

We claim:

1. A fabric support device for use in an automatic washer having a wash basket, the fabric support device comprising:

a container for supporting fabric items adjacent the side wall of a wash basket, the container having perforate walls and an opening such that fabric items may be placed therein, the container further including, a mesh bag having a generally elongated, rectangular shape, and a spring member extending longitudinally along the bag wherein the bag may be rolled into a generally cylindrical shape against the bias of the spring and inserted into the wash basket.

2. The fabric support device according to claim 1 wherein the mesh bag further comprises:

a first wall formed from a plastic mesh material; and a second wall formed from a plastic mesh material which is relatively more rigid than the first wall, the second wall being rigid enough to support the fabric support device in an upright manner when the mesh bag is rolled into a cylindrical shape.

3. The fabric support device according to claim 1 further comprising:

a plurality of spring members extending longitudinally along the bag.

4. The fabric support device according to claim 1 wherein the bag includes an opening for inserting clothes therein, the opening having a closure device.

5. A fabric support device for use in an automatic washer having a wash basket, the fabric support device comprising:

an elongated bag having a generally rectangular shape, the bag being formed from a mesh material which allows fluid to pass therethrough, the bag having an open side edge such that clothes can be inserted into the bag; and at least one resilient spring extending longitudinally along the bag, wherein the resilient spring can be flexed such that the bag can be rolled into a generally cylindrical shape and inserted into the wash basket and upon release of the spring, the spring outwardly biases the bag such that the bag is positioned adjacent the inside surface of the wash basket.

6. A fabric support device for use in an automatic washer having a wash basket, the fabric support device comprising:

a relatively flat, mesh structure having a generally elongated shape, the mesh structure having two adjacent mesh walls joined at their outer periphery for forming an enclosure, the mesh structure further having an opening such that fabric items may be placed therein, wherein the mesh walls are resilient and may be flexed such that the container may be rolled into a generally cylindrical shape and inserted into the wash basket such that the mesh structure radially expands against the side wall of the wash basket when released supporting the fabric items placed in the mesh structure in a relatively fixed position within the wash basket.

7. The fabric support device according to claim 6, further comprising:

at least one spring member provided longitudinally along the mesh structure.

8. The fabric support device according to claim 6, further comprising:

a pair of end members which connect to the mesh structure along the longitudinal ends, the end member having handle openings.

9. The fabric support device according to claim 6, further wherein the mesh walls are formed from a mesh material comprising a plurality of relatively thick strands joined by relatively thin strands wherein the thick strands form a plurality of spring elements giving the fabric support device resiliency.

10. A fabric support device comprising:

a resilient, elongated container having perforate walls, the container having an opening for receiving clothes therein;

at least one spring member extending along the length of the container.

11. The fabric support device according to claim 10, further wherein the fabric support device is for use in an automatic washer having a top opening providing access to a wash basket and the container may be rolled into a generally cylindrical shape against the bias of the spring and inserted through the top opening and released such that the container is biased against the inside surface of the wash basket.

12. The fabric support device according to claim 10, further wherein the container is an elongated structure having a generally rectangular shape, the elongated structure being formed from a mesh material which allows fluid to pass therethrough, the structure having an open side edge provided with a closure device.

13. The fabric support device according to claim 12 wherein the elongated structure further comprises:

a first wall formed from a plastic mesh material; and a second wall formed from a plastic mesh material which is relatively more rigid than the first wall, the second wall being rigid enough to support the fabric support device in an upright manner when the mesh bag is rolled into a cylindrical shape.

14. The fabric support device according to claim 10 wherein a plurality of spring members extend longitudinally along the container.

15. A fabric support device for use in a wash basket of an automatic washer, comprising:

an elongated bag having a generally rectangular shape, the bag being formed from a mesh material which allows fluid to pass therethrough, the bag having an opening such that clothes can be inserted into the bag;

at least one rod extending transversely across the bag for preventing collapse of the bag; and at least one resilient spring extending longitudinally along the bag;

wherein the at least one resilient spring can be compressed such that the bag can be inserted into the wash basket and upon release of the spring, the spring outwardly biases the bag such that the bag is positioned adjacent the inside surface of the wash basket.

16. The fabric support device according to claim 15, further comprising:

a closure device disposed along the opening for securing clothes within the elongated bag.

17. The fabric support device according to claim 15 wherein the elongated bag includes an elongated side edge, the side edge being provided with a closure device such that clothes may be inserted into the bag and secured therein.

18. The fabric support device according to claim 15 wherein the elongated bag has a pair of relatively short transverse edges and a pair of relatively long longitudinal edges, the fabric support device further comprising:

at least three rods, one being located transversely generally in the middle of the elongated bag and the other two being located at the transverse edges of the elongated bag; and a pair of resilient springs extending along the longitudinal edges of the bag, the springs being generally formed in a C-shape such that the bag is arranged in a generally cylindrical shape, wherein the resilient springs can be compressed such that the bag can be inserted into the wash basket and upon release of the springs, the springs outwardly biases the bag such that the bag is positioned adjacent the inside surface of the wash basket.

19. A method for washing delicate fabric items in an automatic washer having a wash basket using a fabric support device, the fabric support device having an elongated, relatively flat shape which is formed from a mesh material, the fabric support device is resilient such that it can be rolled into a cylindrical shape, the method comprising the steps of:

placing delicate fabric items into the fabric support device;

rolling the fabric support device into a cylindrical shape;

inserting the rolled fabric support device into the wash basket;

releasing the fabric support device to allow it to radially expand within the wash basket and press out against the inside wall surface of the wash basket;

initiating an automatic washer wash cycle.

20. The method of washing delicate fabric items in an automatic washer according to claim 19, wherein the delicate fabric items are supported within the wash basket in a manner which minimizes the flexing, stretching and excessive movement of the fabric items.

* * * * *